United States Patent [19]

D'Orsi et al.

[11] Patent Number: 5,074,619

[45] Date of Patent: Dec. 24, 1991

[54] KANGAROO CHAIR

[76] Inventors: Anthony D'Orsi, 2322 62 St., Brooklyn, N.Y. 11204; George Spector, 233 Broadway, Rm. 3815, New York, N.Y. 10007

[21] Appl. No.: 658,337

[22] Filed: Feb. 20, 1991

[51] Int. Cl.[5] ..... A47C 15/00

[52] U.S. Cl. ..... 297/236; 297/144; 297/193; 108/11

[58] Field of Search ..... 297/236, 237, 144, 170, 297/171, 193, 338; 108/11, 13, 15

[56] References Cited

U.S. PATENT DOCUMENTS

| | | | |
|---|---|---|---|
| 1,357,469 | 11/1920 | Palmer | 297/237 |
| 1,881,475 | 10/1932 | Gibson | 108/13 X |
| 2,058,299 | 10/1936 | Cook | 297/237 X |
| 2,743,766 | 5/1956 | Bartman | 297/338 |
| 4,768,827 | 9/1988 | Musgrove | 297/236 |

FOREIGN PATENT DOCUMENTS

| | | | |
|---|---|---|---|
| 687978 | 2/1953 | United Kingdom | 108/13 |

*Primary Examiner*—Kenneth J. Dorner
*Assistant Examiner*—Joanne Bonifanti

[57] ABSTRACT

A convertible chair is provided and consists of a plurality of hollow legs, a seat supported on the hollow legs and having a compartment therein and apertures for communication with the hollow legs, a cover hinged to the seat over the compartment, a back rest extending upwardly from the seat and an auxiliary article of furniture having a flat top and plurality of thin legs which fit into the hollow legs and the compartment in the seat for storage. When needed the seat cover can be opened and the auxiliary article of furniture removed therefrom to be used as a temporary chair, stool, snack table and the like.

4 Claims, 1 Drawing Sheet

KANGAROO CHAIR

BACKGROUND OF THE INVENTION

The instant invention relates generally to foldable chairs and more specifically it relates to a convertible chair which provides an auxiliary article of furniture that can be pulled out of its main frame for temporary use.

There are available various conventional foldable chairs which do not provide the novel improvements of the invention herein disclosed.

SUMMARY OF THE INVENTION

A primary object of the present invention is to provide a convertible chair that will overcome the shortcomings of the prior art devices.

Another object is to provide a convertible chair in which an auxiliary article of furniture can be pulled out of its main frame to be used as a temporary chair, stool or snack table.

A additional object is to provide a convertible chair in which the auxiliary article of furniture can be height adjustably retained within the chair so that it can be used as a temporary high chair.

A further object is to provide a convertible chair that is simple and easy to use.

A still further object is to provide a convertible chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 1:
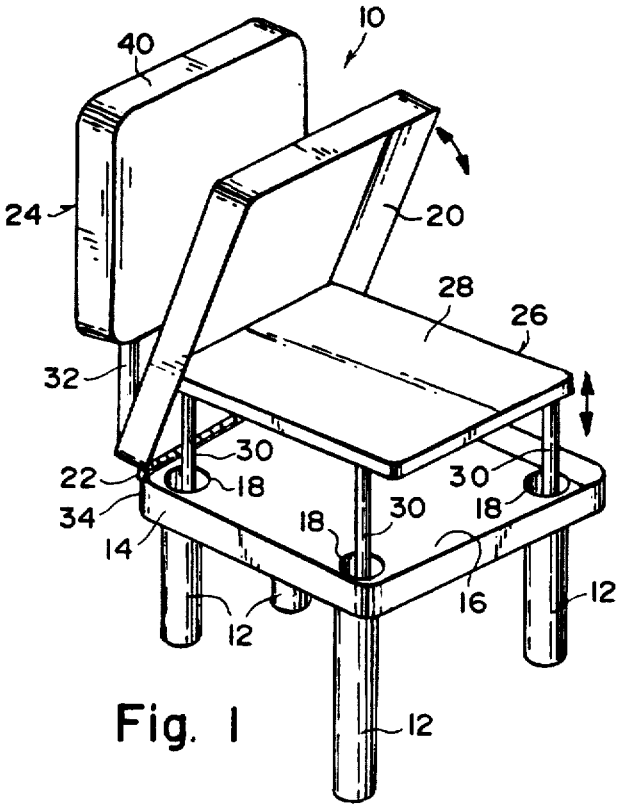
FIG. 1 is a perspective view of the instant invention partly opened.
Figure 2:
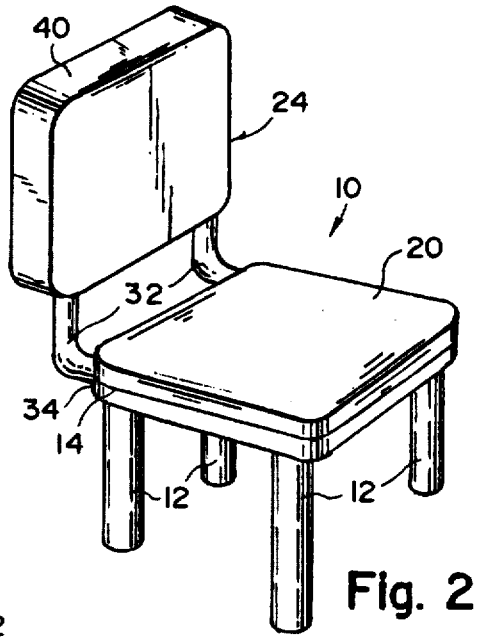
FIG. 2 is a perspective view of the chair thereof closed.
Figure 3:
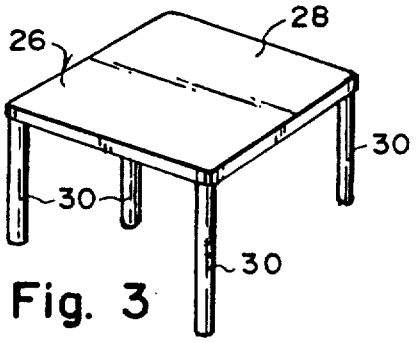

FIG. 3 a perspective view of the auxiliary article of furniture taken therefrom to be used as a temporary chair, stool or snack table.

Figure 4:
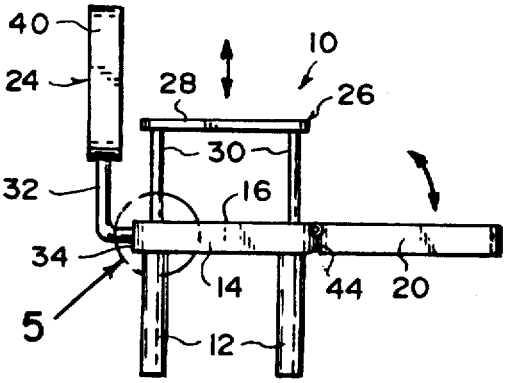

FIG. 4 is a side view of a modification in which the article of furniture can be height adjustably retained within the chair and the cover hinged forward so that it can be used as a temporary high chair.

Figure 5:
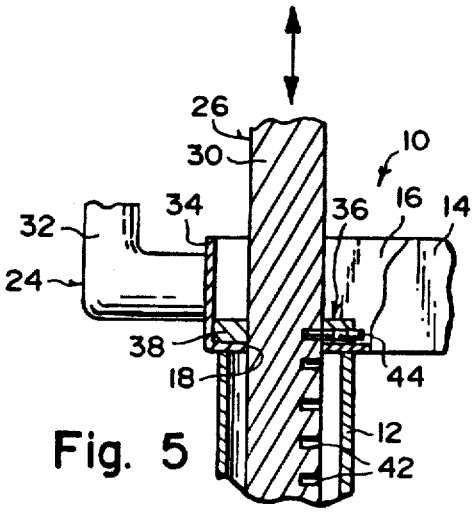

FIG. 5 is an enlarged detail view with parts broken away and in section as indicated by arrow 5 in FIG. 4 showing the leg retaining mechanism therein.

DETAILED DESCRIPTION OF THE PREFERRED EMBODIMENTS

Turning now descriptively to the drawings, in which similar reference characters denote similar elements throughout the several views, the Figures illustrate a convertible chair 10 consisting of a plurality of hollow legs 12, a seat 14 supported on the hollow legs 12 and having a compartment 16 therein and apertures 18 for communication with the hollow legs 12. A cover 20 is hinged at 22 to the seat 14 over the compartment 16, while a back rest 24 extends upwardly from the seat 14. An auxiliary article of furniture 26 is provided having a flat top 28 and plurality of thin legs 30 which fit into the hollow legs 12 and the compartment 16 in the seat 14 for storage. When needed the seat cover 20 can be opened and the auxiliary article of furniture 26 removed therefrom to be used as a temporary chair, stool, snack table and the like.

The back rest 24 includes an L-shaped frame 32 extending from the rear 34 of the seat and a pad 40 affixed to the frame 32. A mechanism 36 is within the compartment 16 of the seat 14 for height adjustably retaining the auxiliary article of furniture 26 thereto so that it can be used as a temporary high chair.

The height adjustable retaining mechanism 36 includes a collar 38 in the compartment 16 of the seat 14 over one of the apertures 18. The respective thin leg 30 of the auxiliary article of furniture 26 has plurality of spaced apart transverse holes 42 therealong. A set screw 44 is threaded into the side of the collar 38 so as to fit into any one of the transverse holes 42 in the respective thin leg 30 to keep the flat top 28 at a stabilized height. The cover 20 is hinged to the front 46 of the seat 14 so that it can open forwardly and be used as a foot rest for a child that sits upon the auxiliary article of furniture 26 as the temporary high chair.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A convertible chair which comprises:
   a) a plurality of hollow legs;
   b) a seat supported on said hollow legs and having a compartment therein and apertures for communication with said hollow legs;
   c) a cover hinged to said seat over said compartment;
   d) a back rest extending upwardly from said seat; and
   e) an auxiliary article of furniture having a flat top and a plurality of thin legs which fit into said hollow legs and the compartment in said seat for storage so that when needed said seat cover can be opened and said auxiliary article of furniture removed therefrom to be used as a temporary chair, stool, or snack table.

2. A convertible chair as recited in claim 1, wherein said back rest includes an L-shaped frame extending from the rear of said seat and a pad affixed to said frame.

3. A convertible chair as recited in claim 2, further including means within the compartment of said seat for height adjustably retaining said auxiliary article of furniture thereto so that it can be used as a temporary high chair.

4. A convertible chair as recited in claim 3, wherein said height adjustable retaining means includes:
   a) a collar in said compartment of said seat over one of said apertures;
   b) said respective thin leg of said auxiliary article of furniture having a plurality of spaced apart transverse holes therealong;
   c) a set screw threaded into the side of said collar so as to fit into any one of said transverse holes in said respective thin leg to keep said flat top at a stabilized height; and
   d) said cover hinged to the front of said seat so that it can open forwardly and be used as a foot rest for a child that sits upon said auxiliary article of furniture as the temporary high chair.

* * * * *